US006434793B1

(12) United States Patent
Ensson

(10) Patent No.: US 6,434,793 B1
(45) Date of Patent: Aug. 20, 2002

(54) DEVICE ARRANGED AT THE END OF A HANDLE

(76) Inventor: Lars Johnny Ensson, Storgatan 26, SE-671 21 Arvika (SE)

( * ) Notice: Subject to any disclaimer, the term of this patent is extended or adjusted under 35 U.S.C. 154(b) by 0 days.

(21) Appl. No.: 09/647,450

(22) PCT Filed: Mar. 26, 1999

(86) PCT No.: PCT/SE99/00479

§ 371 (c)(1),
(2), (4) Date: Nov. 30, 2000

(87) PCT Pub. No.: WO99/49755

PCT Pub. Date: Oct. 7, 1999

(30) Foreign Application Priority Data

Mar. 31, 1998 (SE) ..... 9801136

(51) Int. Cl.[7] ..... E05B 1/00; B25G 1/04

(52) U.S. Cl. ..... 16/421; 16/441; 16/436; 15/143.1; 15/246

(58) Field of Search ..... 16/421, 441, 430, 16/431, 436, 412, DIG. 12, DIG. 18, DIG. 19; 248/110, 111; 294/58; 15/246, 143.1; 81/177.1, 436, 489

(56) References Cited

U.S. PATENT DOCUMENTS

| | | | | | |
|---|---|---|---|---|---|
| 184,918 | A | * | 11/1876 | Siddall | 16/441 |
| 277,298 | A | * | 5/1883 | Lincoln | 16/431 |
| 751,356 | A | * | 2/1904 | Smith | 16/431 |
| 1,443,596 | A | * | 1/1923 | Schaefer | 16/441 |
| 1,556,966 | A | * | 10/1925 | Selig | 16/DIG. 12 |
| 1,609,414 | A | * | 12/1926 | Lenny | 15/143.1 |
| 1,803,375 | A | * | 5/1931 | Adams | 16/412 |
| 1,980,655 | A | * | 11/1934 | Balistreri | 15/143.1 |
| 2,130,694 | A | * | 9/1938 | Newman | 16/441 |
| 3,699,613 | A | * | 10/1972 | Skinner | 16/441 |
| 4,052,768 | A | * | 10/1977 | Yamazaki et al. | 16/441 |
| 4,093,008 | A | * | 6/1978 | Martin | 81/489 |
| 4,991,461 | A | * | 2/1991 | Sennett et al. | 16/441 |
| 5,581,839 | A | | 12/1996 | Ferrell, Jr. | 15/143.1 |

FOREIGN PATENT DOCUMENTS

| | | | |
|---|---|---|---|
| DE | 30 04 315 A1 | 8/1981 | |
| EP | 0 568 110 A3 | 3/1993 | A47L/13/24 |
| EP | 0 568 110 A2 | 3/1993 | A47L/13/255 |
| FR | 1159107 | 6/1958 | |
| WO | 99/11171 | 3/1999 | A47L/13/42 |

OTHER PUBLICATIONS

International Preliminary Examination Report dated Apr. 2000 for PCT/SE99/00479.
International Search Report dated Aug. 1999 for PCT/SE99/00479.

* cited by examiner

*Primary Examiner*—Chuck Y. Mah
(74) *Attorney, Agent, or Firm*—George T. Marcou; Kilpatrick Stockton LLP

(57) ABSTRACT

The present invention relates to a device for a handle. The invention is characterized in that it comprises a part (20) intended to be arranged at the end of a handle, referred to below as a holding part, that the holding part (20) comprises a part (22) intended to be gripped on use, referred to below as the gripping pant, that said holding part is provided with organs (10, 20) capable of allowing turning of the gripping part (22) around an axis of rotation (V) in relation to the handle when device is affixed to the handle end, the axis of rotation (V) coinciding in the main with the longitudinal direction (L) of the handle, and that the gripping part is provided with organs (34, 36) capable of increasing the friction between the holding pant and the hand or a surface which the handle end is placed against.

8 Claims, 1 Drawing Sheet

DEVICE ARRANGED AT THE END OF A HANDLE

TECHNICAL FIELD

The present invention relates to a handle device.

BACKGROUND TO THE INVENTION

A lot of work is performed using various devices provided with a handle, such as cleaning mops, brooms, scrubbing brushes and the like. A conventionally formed handle end does not allow many possibilities of different grips. For example, it is difficult and surface, which surface roughly corresponds to the cross-sectional surface of the handle.

When working, the device often needs to be turned by twisting the handle around its longitudinal axis, as for example when cleaning around furniture and similar with cleaning mops This turning is disadvantageous from the ergonomic point of view, as it is a strain on the wrists, and/or the handle end digs into the palm of the hand if it is held with one hand.

Another aspect of the above devices with a handle is when these are occasionally put on one side, the handle end usually being leaned against a wall or similar. Due to the low friction between the handle end and the base, the handle very often has a tendency to slide off and the handle ends tip on the floor.

ACCOUNT OF TH INVENTION

The object of the present invention is to remedy the above problems. This is achieved according to an aspect of the invention by a device according to the introduction, characterized in that it comprises a part intended to be arranged at the end of a handle, referred to below as the holding part, that the holding part comprises a part intended to be gripped on use, referred to below as the gripping part, that said holding part is provided with organs capable of allowing turning of the gripping part around an axis of rotation in relation to the handle when the device is affixed to the handle end, the axis of rotation coinciding in the main with the longitudinal direction of the handle, and that the gripping part is provided with organs capable of increasing the friction between the holding part and the band or a surface which the handle end is placed against.

According to another aspect of the invention, it is characterized in that the gripping part is formed to be convexly rotation-symmetrical, preferably-essentially spherical. An egg shape, plum shape, pear shape and the shape of a globe which is somewhat flattened can be mentioned among the shapes included in the definition "essentially spherical".

According to a further aspect of the invention, it is characterized in that the friction-increasing organ is located in the vicinity of the gripping part's "equator", i.e. a plane at right angles to the axis of rotation V at the place where the gripping part has the greatest diameter.

According to yet another aspect of the invention, it is characterized in that the band and the groove have a shape and positioning on the gripping part such that the lower edge of the groove is located in the vicinity of the equator and that the gripping part acquires an essentially spherical shape when the band is fitted.

According to a further aspect of the invention, it is characterized in that the band has an essentially circular form seen in cross-section, and that the band and the groove have a form such that the band, when it is fitted, extends a distance outside the surface of the gripping part.

The advantages of the device according to the invention are several. Due to the fact that the gripping part is rotatable in relation to the handle, the upper hand which holds the gripping part is kept still during use, which simplifies maneuvering and renders utilisation more flexible as well as improving the ergonomics. The essentially spherical shape of the gripping part gives a grip-friendly functional device with many possibilities of different grips.

Due to the fact that the gripping part is provided with friction-increasing organs, preferably arranged in the vicinity of the gripping part's equator, a better grip is obtained during use on the one hand and on the other hand increased friction is obtained between the handle end and a surface, for example a wall surface, when the handle is put on one side and leaned against a wall surface, where the increased friction prevents the handle from sliding along the surface and falling down onto the floor.

These and other aspects and advantages of the present invention will be evident from the detailed description of a few preferred embodiments and from the following claims.

BRIEF DESCRIPTION OF DRAWINGS

In the description of a few preferred embodiments below, reference will be made to the enclosed drawings. In these

DESCRIPTION OF PREFERRED EMBODIMENTS

Figure 2:
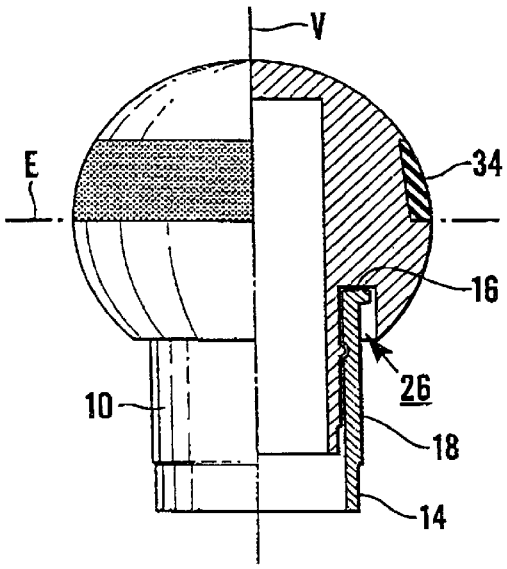
FIG. 2 shows a lateral view in partial section of the device according to FIG. 1.

The device which is shown in the drawings comprises a cylindrical sleeve 10, the outer diameter of which corresponds to the inner diameter of the handle 12 to which it is to be is affixed. The lower end 14 of the sleeve, FIG. 2, is slightly undercut to make it easier to insert the sleeve into the handle end. The sleeve is then held in place preferably by clamping. It is of course also conceivable to attach the sleeve by means of gluing, riveting etc. The upper end of the sleeve is provided with a flange 16 which on insertion bears on the end surface of the handle. Arranged on the inside of the sleeve is a groove 18 at a distance down from the upper end edge, which groove runs around the inner circumference of the sleeve.

Figure 3:
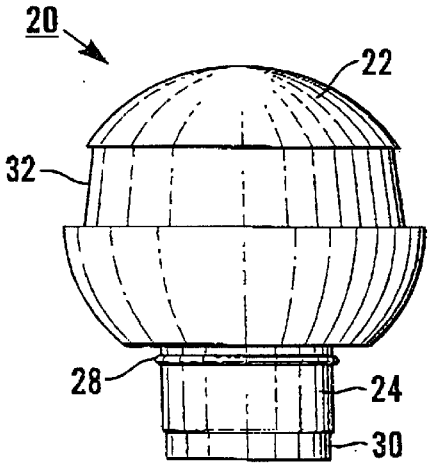
FIG. 3 shows a lateral view of a detail forming part of the invention according to FIG. 1

The device also comprises a holding part 20, FIG. 3, with an essentially spherical gripping part 22 and an essentially cylindrical dowel part 24. Arranged at the attachment between the gripping part and the dowel part is a circular recess or groove 26. The dowel part is also provided with a flange 28 at a distance down from the bottom of the groove 26, which flange runs around the circumference of the dowel part. This distance corresponds to the distance between the groove 18 and the upper edge of the sleeve, The lower end of the dowel part, FIG. 3, is provided with an undercut 30. The holding part 20 is intended to be pushed down into the sleeve 10 until the flange 28 on the holding part fits into the groove 18 in the sleeve, the bottom of the recess 26 coming to bear on the upper edge of the sleeve. The dowel part is formed with a diameter which is somewhat smaller than the inner diameter of the sleeve, which means that the holding device can be rotated in relation to the sleeve around an axis of rotation V which coincides with the longitudinal direction L of the handle, at the same time as the holding device is held in place in relation to the sleeve in the longitudinal direction thanks to the fitting of the flange into the groove.

Figure 1:
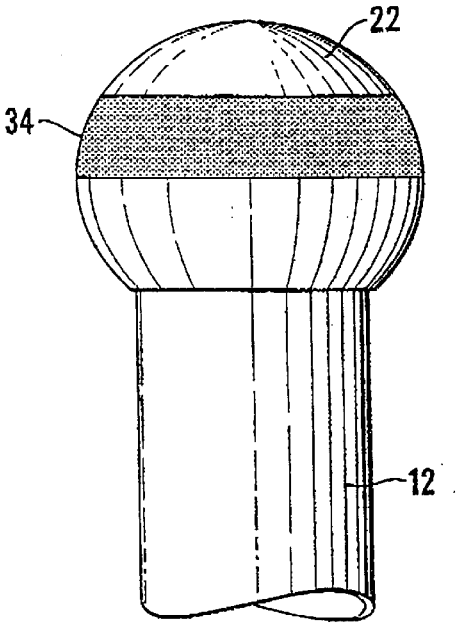
FIG. 1 shows a lateral view of the device according to the invention mounted on a handle.

The gripping part is provided in the first embodiment, FIGS. 1–3, with a groove 32 or recess around its periphery essentially at right angles to the axis of rotation. The groove has a certain width where one edge is located principally on the "equator" E of the gripping part, i.e. a plane at right angles to the axis of rotation V at the place where the gripping part has the greatest diameter, and with its other edge at a distance above it, FIG. 3.

A ring 34 of elastic friction-increasing material with a cross-section corresponding to the cross-section of the groove is arranged in the groove, the gripping part acquiring an essentially spherical form where one part of its surface has a friction-increasing area.

Figure 4:
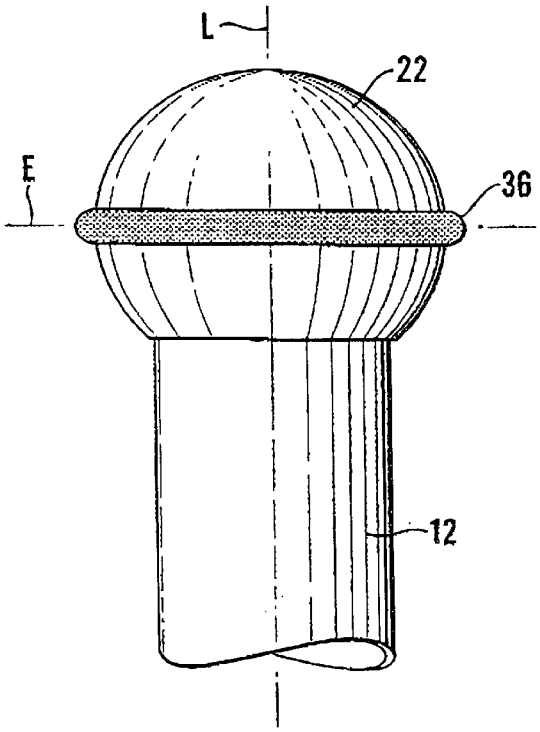
FIG. 4 shows a variant of the device according to FIG. 1.

In the embodiment according to FIG. 4, the elastic friction-increasing ring is formed as an 0-ring 36 with an essentially circular cross-section. The gripping part is provided in this case with an essentially U-shaped groove located principally on its "equator". The groove has a depth which means that the 0-ring, when this is arranged in the groove, extends a distance outside the surface of the gripping part.

It should be understood that the invention is not restricted to the embodiment described above and shown in the drawings, but can be modified within the scope of the following claims. Thus the gripping part can be arranged at the end of the handle in a number of ways which allow rotation of the gripping part in relation to the handle around an axis of rotation which coincides with the longitudinal direction of the handle.

Furthermore, the friction-increasing part of the gripping part can be formed in a number of different ways and with different surfaces, and covering parts of various sizes of the gripping part to achieve the desired function.

What is claimed is:

1. Device for a handle comprising a part (20) intended to be arranged at the end of a handle, referred to below as the holding part, said holding part (20) comprising a part (22) intended to be gripped on use, referred to below as the gripping part, wherein the holding part is provided with organs (10, 20) capable of allowing turning of the gripping part (22) around an axis of rotation (V) in relation to the handle when the device is affixed to the handle end, the axis of rotation (V) coinciding in the main with the longitudinal direction (L) of the handle, characterized in that the gripping part (22) is designed substantially spherical and provided with organs (34, 36) capable of increasing the friction between the holding part and the hand or a surface which the handle end is placed against; and further characterized in that the organ capable of allowing turning comprises a cylindrical sleeve (10) intended to be attached at the end of a handle, that the holding part (20) comprises a dowel part (24) intended to fit into the sleeve, these being adapted so as to allow turning of the holding part in relation to the sleeve, and thereby the handle.

2. Device according to claim 1, characterized in that the friction-increasing organ (34, 36) is formed on at least a part of the surface of the gripping part, however not on the top of the gripping part.

3. Device according to claim 2, characterized in that the friction-increasing organ is located in the vicinity of the "equator" of the gripping part, i.e. a plane at right angles to the axis of rotation (V) at the place where the gripping pail has the greatest diameter.

4. Device according to claim 2, characterized in that the friction-increasing organ is formed as a band of elastic material, arranged in a groove (32) in the surface of the gripping part.

5. Device according to claim 4, characterized in that the band (34) and the groove (32) have a shape and positioning on the gripping part such that the lower edge of the groove is located in the vicinity of the equator (E) and that the gripping part acquires an essentially spherical shape when the band is affixed.

6. Device according to claim 4, characterized in that the band (36) has an essentially circular form seen in a cross-section, and that the band and groove have a form such that the band, when it is affixed, extends a distance outside the surface of the gripping part.

7. Device according to claim 1, characterized in that the sleeve and the dowel part comprise organs (18, 28) capable of preventing withdrawal of the dowel part from the sleeve following fitting.

8. device according to claim 7, characterized in that the organ capable of preventing withdrawal comprises a groove (18) on the inside of the sleeve and a flange (28) on the outside of the dowel part, the flange fitting into the groove when the dowel part is fitted into the sleeve.

* * * * *